United States Patent [19]

Anderson

[11] Patent Number: 4,852,318

[45] Date of Patent: Aug. 1, 1989

[54] BULL NOSE CORNER PIECE

[76] Inventor: Arthur Anderson, 45-700 Rancho Palmeras, Indian Wells, Calif. 92210

[21] Appl. No.: 173,115

[22] Filed: Mar. 24, 1988

[51] Int. Cl.[4] ..... E04F 19/02; E04B 1/00

[52] U.S. Cl. ..... 52/288; 52/287; 52/716

[58] Field of Search ..... 52/288, 290, 287, 277, 52/716, 254, 255, 256, 257

[56] References Cited

U.S. PATENT DOCUMENTS

| | | | |
|---|---|---|---|
| 1,049,733 | 1/1913 | Knapp | 52/255 |
| 2,044,787 | 6/1936 | Harshbey, Jr. et al. | 52/277 |
| 2,069,289 | 2/1937 | Swendsen et al. | 52/716 |
| 2,144,044 | 4/1938 | Bonnell | 52/288 |
| 2,307,338 | 1/1943 | Sluyter et al. | 52/288 |
| 2,620,525 | 12/1952 | Ketchum | 52/282 |
| 2,904,856 | 9/1959 | Robinson | 52/255 |
| 2,915,794 | 12/1959 | Hillmann | 52/288 |
| 3,559,356 | 2/1971 | Koral | 52/254 |
| 3,712,003 | 1/1973 | Hallock et al. | 52/254 |
| 3,956,861 | 5/1976 | Rasmussen | 52/287 |
| 4,104,839 | 8/1978 | Balzer et al. | 52/288 |
| 4,150,517 | 4/1979 | Warner | 52/288 |
| 4,161,853 | 7/1979 | Weiss et al. | 52/288 |
| 4,267,677 | 5/1981 | Randolph et al. | 52/242 |
| 4,430,833 | 2/1984 | Balzer et al. | 52/255 |
| 4,621,471 | 11/1986 | Kuhr et al. | 52/288 |
| 4,642,957 | 2/1987 | Edwards | 52/242 |

FOREIGN PATENT DOCUMENTS

| | | | |
|---|---|---|---|
| 531471 | 9/1954 | Belgium | 52/288 |
| 909537 | 5/1946 | France | 52/288 |
| 568852 | 4/1945 | United Kingdom | 52/287 |

*Primary Examiner*—Michael Safavi

*Attorney, Agent, or Firm*—William W. Haefliger

[57] ABSTRACT

A corner piece interfits with an approximately 90° corner defined by two upright walls, a thin protective strip attached to the two walls and elongated vertically, the strip having a rounded nose extending outwardly from planes defined by the walls and around the corner, and two like base boards that respectively extend adjacent the lowermost side of the walls and toward the corner. The corner piece comprises:

(a) a generally L-shaped corner piece body having two arms that extend flatly adjacent the respective walls between the base boards and the corner, the arms having substantially the same height and thickness as the base boards to simulate continuations thereof and the arms being attachable to the walls, (b) the corner piece having a rounded nose that is spaced outwardly of the corner and that merges with the two arms, (c) The corner-piece defining a recess that is spaced inwardly of the corner-piece nose and rounded in parallel relation thereto, the recess extending endwise into the arms, and the recess opening toward the strip to receive and conveal the rounded nose of the strip at the levels of the arms.

7 Claims, 2 Drawing Sheets

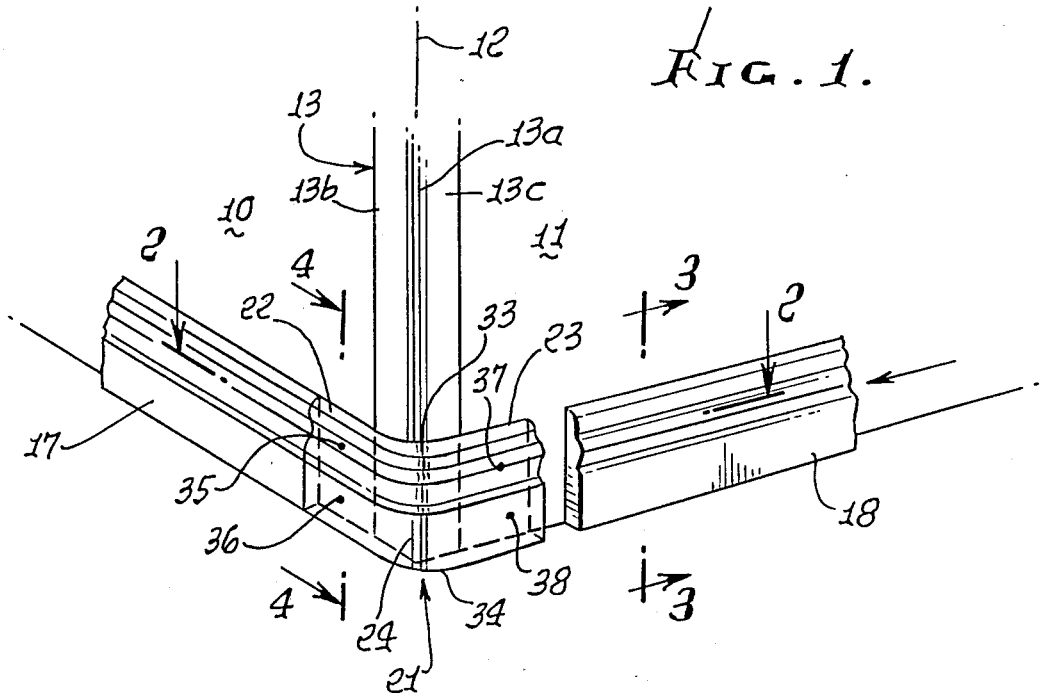
FIG. 1.
FIG. 2.
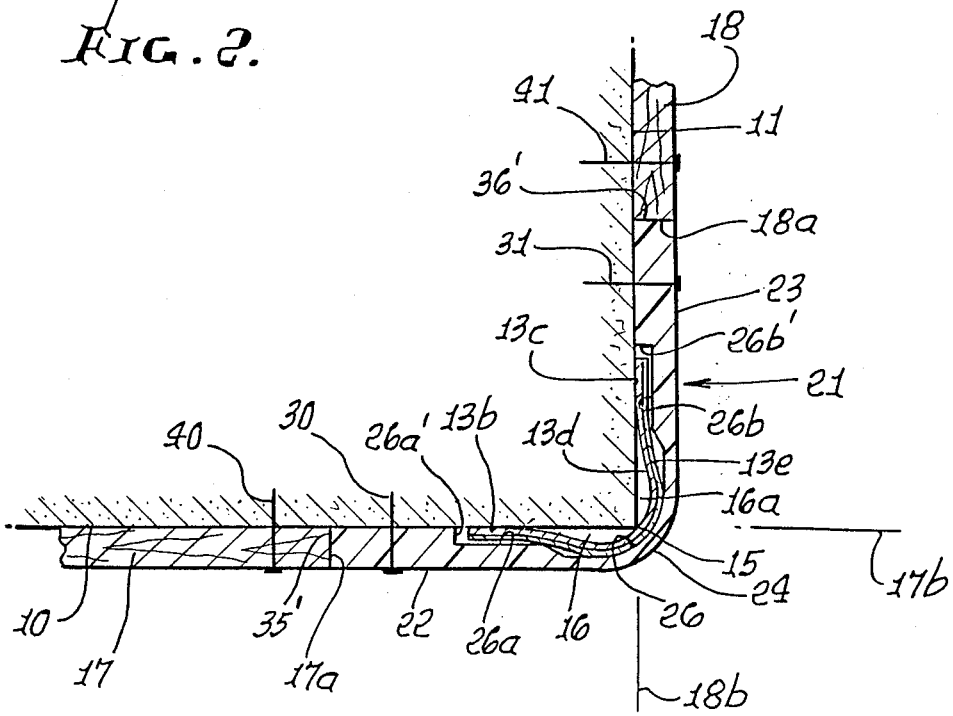

BULL NOSE CORNER PIECE

BACKGROUND OF THE INVENTION

This invention relates generally to the installation of protective baseboards, as at the lower extents of walls; and more particularly it concerns intallation of wall corner protective elements in association with base boards.

There is need for wall corner protection, as by installing so-called "bull nose" strips which are rounded to cover sharp corners formed where two walls meet. This presents a problem at base board level, since base boards are straight, and cannot conform to the lower ends of rounded bull nose strips. Various devices proposed to solve this problem are complex, difficult and time-consuming to install, and are generally unsatisfactory. There is need for a simple, quickly installed means to solve this problem and to give the walls and corner a finished, attractive appearance, at base board level.

SUMMARY OF THE INVENTION

It is a major object of the invention to provide a solution to this problem, in the form of a quickly and easily installed corner-piece that conforms to both the elongated "bull nose" strip, and to base boards.

As will appear, the invention is embodied in:

(a) a generally L-shaped corner piece having two arms that extend flatly adjacent the respective walls between said base boards and said corner, said arms having substantially the same height and thickness as said base boards to simulate continuations thereof and said arm being attachable to said walls, (b) the corner piece having a rounded nose that is spaced outwardly of the corner and that merges with said two arms, (c) the corner-piece defining a recess that is spaced inwardly of said corner-piece nose and rounded in parallel relation thereto, the recess extending endwise into said arms, and the recess opening toward said strip to receive and conceal said rounded nose of the strip at the levels of said arms.

It is another object to provide a corner piece that has an outer surface which is everywhere confined at the corner side of planes defined by the outer sides of the baseboards.

A further object is to provide a corner piece recess which has a rounded concave configuration to locatingly interfit the rounded nose of the strip, which is convex. The depth of the recess is typically substantially uniform over the length thereof between said legs and into which the recess extends.

A yet further object is to provide a unique, rapid method of assembling such elements, the method including the steps:

(i) attaching the strip to the walls so that its rounded nose extends closely over and about the corner, (ii) attaching the corner-piece arms to the walls so that the recess closely receives the strip rounded nose and locates the corner piece and said arms thereof relative to the walls, (iii) and then advancing the base boards toward the arms of the corner piece to endwise abut the ends of said arms, (iv) and then attaching the base boards to the walls.

These and other objects and advantages of the invention, as well as the details of an illustrative embodiment, will be more fully understood from the following specification and drawings, in which:

DRAWING DESCRIPTION

FIG. 1 is a perspective view of a wall corner, base boards, bull nose strip, and corner-piece in accordance with the invention;

FIG. 2 is an enlarged horizontal section taken on lines 2—2 of FIG. 1;

DETAILED DESCRIPTION

Figure 5:
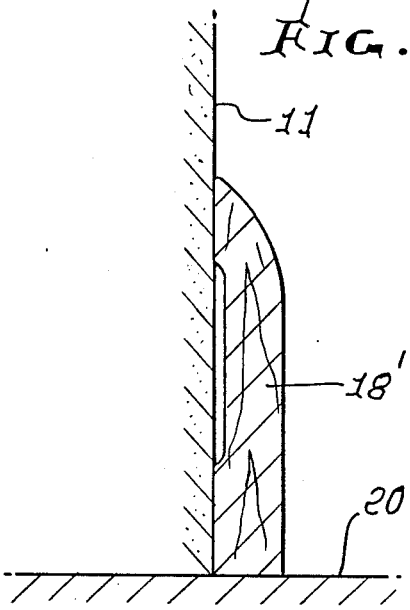
FIG. 5 is a view like FIG. 3, showing a different configuration base board.

In FIGS. 1–4, two upright walls 10 and 11 define a corner 12, which is typically a 90° corner, although that angle can vary, so long as a corner is defined.

Attached to the walls is a thin protective strip 13, which is vertically elongated as shown. That strip has a rounded nose **13*a*, and thin flat arms 13*b* and 13*c* that merge with the nose and extend adjacent the walls, for attachment to them, as by adhesive. The thickness of the strip is less than about 1/16 inch. It may comprise an inner metal layer 13*d*, and a superimposed outer paper or fabric layer 13*e*, as seen in FIG. 2. The nose 13*a* extends closely around the corner 12, touching it for example at 15 so as to be spaced at 16 and 17 from the walls, the nose then curved back inwardly toward the walls to merge with arms 13*b* and 13*c***, as shown. Thus the strip gives the wall a rounded corner appearance, and protects that corner as from furniture impacts.

Two like protective and decorative base boards 17 and 18 respectively extend adjacent the lowermost outer ends of the walls, i.e. just above floor or carpet level 20. Those boards extend toward the strip 13, and have ends **17*a* and 18*a*** spaced from the strip. The base boards normally consist of wood.

In accordance with the invention, a generally L-shaped corner-piece 21, typically of molded plastic material, has two arms 22 and 23 that extend flatly adjacent the respective walls 10 and 11, between the base boards and the corner 12. The arms have substantially the same height and thickness as the base boards to simulate continuation of the latter.

The corner-piece also has a rounded nose 24 that is spaced outwardly of the corner 12 and that merges with the two arms. Note that the arms and nose 22–24 are everywhere confined at the corner 12 side of two planes **17*b* and 18*b* defined by the outermost sides of the base boards, whereby the outwardly bulged and obstructing effect of the strip nose 13*a*** is eliminated, at the level of the base boards and corner piece.

The corner piece 21 defines a recess 26 spaced inwardly of the corner piece nose outer surface, and the recess is rounded in parallel relation to the nose 24; also, the recess extends endwise at **26*a* and 26*b*, parallel to walls 10 and 11 respectively, into the two arms 22 and 23, but terminates at 26*a*′ and 26*b*′ short of the ends 22*a* and 23*a* of the arms. Thus, portions 22*b* and 23*b* of the arms spaced from the recess and the ends of the arm have full thickness, for nailing as at 30 and 31** into the walls.

The recess 26, and at 26*a* and 26*b* opens inwardly toward the strip 13 and elements 13*a*, 13*b* and 13*c* thereof, to receive such elements, as shown in FIG. 2. The convex strip nose 13*a* engages the correspondingly rounded concave inner wall 26*d* to precisely and quickly locate the corner piece, upon assembly as by a carpenter. Also, the strip bulged lower extent is thereby protectively and decoratively concealed in the recess. The recess 26 also extends between and opens at, the top and bottom of the corner piece. Arms 22 and 23 can flex toward walls 10 and 11 due to spaces between 13*b* and 26*a*, and between 13*c* and 26*b*.

After the corner piece is located in position, it is nailed to the walls, as by upper and lower nails 35 and 36, and upper and lower nails 37 and 38. Then, the two base boards are moved endwise so that they endwise abut the corner piece arm ends, as at 35' and 36'. The base boards are nailed to the walls, as at 40 and 41.

The steps of the assembly include the following:

(i) attaching the strip to the walls so that its rounded nose extends closely over and about the corner, (ii) attaching the corner-piece arms to the walls so that the recess closely receives the strip rounded nose, and so that the strip rounded nose locates the corner piece and said arms thereof relative to the walls, (iii) and then advancing the base boards toward the arms of the corner piece to endwise abut the ends of said arms, (iv) and then attaching the base boards to the walls.

Figure 6:
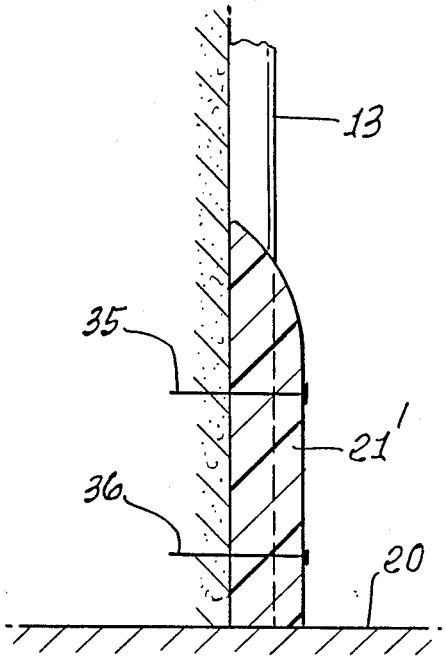
FIG. 6 is a view like FIG. 5 showing a different configuration base board.
Figure 3:
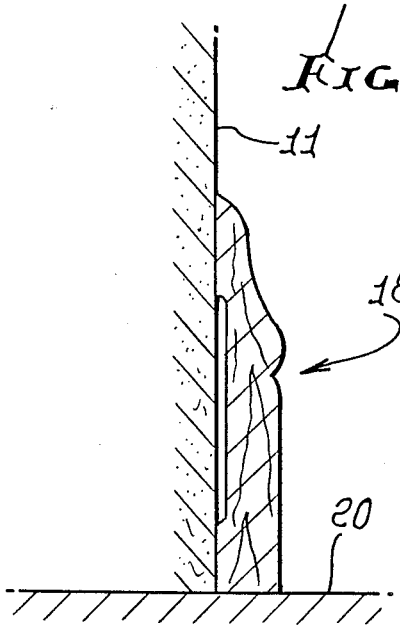
FIG. 3 is an enlarged vertical section taken on lines 3—3 of FIG. 1.
Figure 4:
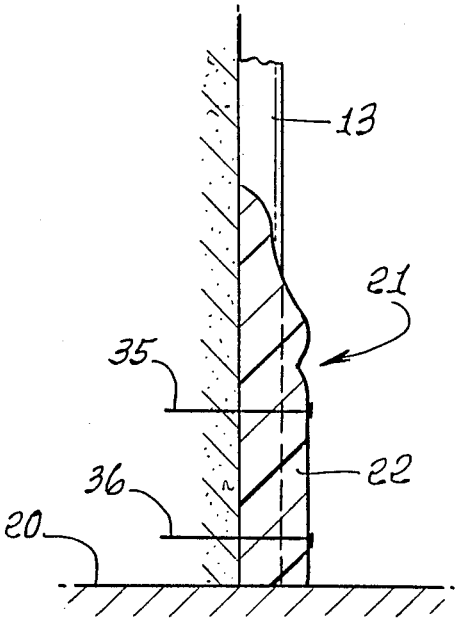
FIG. 4 is an enlarged vertical section taken on lines 4—4 of FIG. 1.

The base boards may have various outer surface shapes, and cross-sections, the one shown being illustrative only. See alternate base boards 18' and 17' in FIGS. 5 and 6.

I claim:

1. In combination with an approximately 90° corner defined by two upright walls, a thin protective strip attached to the two walls and elongated vertically, the strip having a rounded nose extending outwardly from planes defined by the walls and around said corner, and two like base boards that respectively extend adjacent the lowermost side of the walls and toward said corner, the combination comprising:

(a) a generally L-shaped corner piece having two arms that extend flatly adjacent the respective walls between said base boards and said corner, said arms having substantially the same height and thickness as said base boards to simulate continuations thereof and said arms being attachable to said walls, (b) the corner piece having a rounded nose that is spaced outwardly of the corner and that merges with said two arms, (c) the corner-piece defining a recess that is spaced inwardly of said corner-piece nose and rounded in parallel relation thereto, the recess having straight portions extending endwise into said arms, and the recess opening toward said strip to receive and conceal said rounded nose of the strip, the strip having curvature relative to said corner piece nose such that said arms extend respectively into said straight portions of the recess, the strip arms having thicknesses, and the straight portions of the recesses having depths exceeding said thicknesses of the arms of the strip, (d) the recess having an inner wall that is concave and the strip rounded nose contacting the wall corner and also contacting the inner wall of the recess, proximate said nose.

2. The combination of claim 1 wherein the two base boards and said arms having abutting ends.

3. The combination of claim 2 wherein each arm has an outer surface, and each base board has an outer surface, the outer surfaces of the base board and arm adjacent one of the walls being flush.

4. The combination of claim 1 including nails driven through each arm and to the wall, at locations spaced from the recess.

5. The combination of claim 1 wherein the recess has a rounded concave configuration to locatingly interfit the rounded nose of the strip, which is convex.

6. The combination of claim 1 wherein the corner piece consists of flexible molded plastic material.

7. The combination of claim 1 wherein the depths of the recess straight portions are substantially uniform over the lengths thereof.

* * * * *